US007431020B2

(12) United States Patent
Ramamurthy

(10) Patent No.: US 7,431,020 B2
(45) Date of Patent: Oct. 7, 2008

(54) ADAPTIVE FUEL DELIVERY MODULE IN A MECHANICAL RETURNLESS FUEL SYSTEM

(75) Inventor: Dhyana Ramamurthy, Novi, MI (US)

(73) Assignee: DENSO International America, Inc., Southfield, MI (US)

( * ) Notice: Subject to any disclaimer, the term of this patent is extended or adjusted under 35 U.S.C. 154(b) by 23 days.

(21) Appl. No.: 11/607,108

(22) Filed: Nov. 30, 2006

(65) Prior Publication Data

US 2008/0127944 A1 Jun. 5, 2008

(51) Int. Cl.
*F02M 37/04* (2006.01)

(52) U.S. Cl. ..... 123/497; 123/514; 123/458

(58) Field of Classification Search ..... 123/497, 123/446, 198 D, 198 DB, 510, 511, 514, 123/458
See application file for complete search history.

(56) References Cited

U.S. PATENT DOCUMENTS

| | | | | | |
|---|---|---|---|---|---|
| 4,248,194 | A * | 2/1981 | Drutchas et al. | ..... | 123/357 |
| 4,926,829 | A * | 5/1990 | Tuckey | ..... | 123/497 |
| 5,044,344 | A * | 9/1991 | Tuckey et al. | ..... | 123/497 |
| 5,148,792 | A * | 9/1992 | Tuckey | ..... | 123/497 |
| 5,237,975 | A * | 8/1993 | Betki et al. | ..... | 123/497 |
| 5,265,644 | A * | 11/1993 | Tuckey | ..... | 137/510 |
| 5,284,119 | A * | 2/1994 | Smitley | ..... | 123/497 |
| 5,337,718 | A * | 8/1994 | Tuckey | ..... | 123/464 |
| 5,398,655 | A * | 3/1995 | Tuckey | ..... | 123/456 |
| 5,411,002 | A * | 5/1995 | Smitley | ..... | 123/497 |
| 5,505,180 | A * | 4/1996 | Otterman et al. | ..... | 123/497 |
| 5,579,738 | A * | 12/1996 | Frischmuth et al. | ..... | 123/497 |
| 5,701,869 | A * | 12/1997 | Richardson et al. | ..... | 123/497 |
| 5,752,490 | A * | 5/1998 | Rodgers et al. | ..... | 123/497 |
| 5,765,535 | A * | 6/1998 | Radermacher | ..... | 123/497 |
| 5,819,709 | A * | 10/1998 | Holmes et al. | ..... | 123/497 |
| 6,223,731 | B1 * | 5/2001 | Yoshiume et al. | ..... | 123/497 |
| 6,279,541 | B1 | 8/2001 | Doane et al. | | |
| 6,305,362 | B1 * | 10/2001 | Kitamura et al. | ..... | 123/520 |
| 6,318,344 | B1 * | 11/2001 | Lucier et al. | ..... | 123/516 |
| 6,357,422 | B1 * | 3/2002 | Doane et al. | ..... | 123/458 |
| 6,532,941 | B2 * | 3/2003 | Begley et al. | ..... | 123/497 |
| 6,581,574 | B1 * | 6/2003 | Moran et al. | ..... | 123/497 |
| 6,715,470 | B2 * | 4/2004 | Takahashi | ..... | 123/458 |
| 6,840,222 | B2 * | 1/2005 | Schilling et al. | ..... | 123/458 |
| 6,877,488 | B2 * | 4/2005 | Washeleski et al. | ..... | 123/497 |
| 6,925,990 | B1 * | 8/2005 | Konopacki | ..... | 123/497 |
| 7,188,608 | B2 * | 3/2007 | Wilson et al. | ..... | 123/456 |
| 2002/0020397 | A1 * | 2/2002 | Begley et al. | ..... | 123/497 |
| 2003/0221675 | A1 * | 12/2003 | Washeleski et al. | ..... | 123/497 |

* cited by examiner

*Primary Examiner*—Thomas N Moulis
(74) *Attorney, Agent, or Firm*—Harness, Dickey & Pierce, PLC

(57) ABSTRACT

A returnless fuel system has a fuel pump whose speed is varied by varying the voltage across the fuel pump. Controlling the fuel pump speed entails sensing the back pressure with a pressure sensor that may lie between the jet pump supply orifice and the pressure regulator in the pressure regulator case. A trigger circuit determines the absolute value of the difference between the sensed back pressure and an average, or predetermined target, pressure and compares it to a predetermined pressure value. If the absolute value is greater than the predetermined value, then a control circuit is invoked that compares the sensed pressure to a high threshold pressure and a low threshold pressure, and based upon such comparisons, the speed of the fuel pump is varied or maintained such that the mean pressure of the fuel system is targeted under all engine consumption conditions.

15 Claims, 5 Drawing Sheets

ADAPTIVE FUEL DELIVERY MODULE IN A MECHANICAL RETURNLESS FUEL SYSTEM

FIELD

The present disclosure relates to a mechanical returnless fuel system, and more specifically, to an adaptive fuel delivery module in a conventional, mechanical returnless fuel system in which back pressure is used to estimate engine fuel demand and adjust fuel pump speed.

BACKGROUND

The statements in this section merely provide background information related to the present disclosure and may not constitute prior art. Conventional vehicular fuel systems, such as those installed in automobiles, may employ a "return fuel system" whereby a fuel supply tube is utilized to supply fuel to an engine and a fuel return line is utilized to return, hence "return fuel system," unused fuel to a fuel tank. Such return fuel systems require the use of both, a supply line to and a return fuel line from the engine. More modern vehicles typically employ a "returnless fuel system" that may either be mechanically or electronically controlled.

Regarding such returnless fuel systems, such as a mechanical returnless fuel system ("MRFS"), only a fuel supply line from a fuel tank to an engine is utilized; therefore, no return fuel line from the engine to the fuel tank is necessary. As a result, a MRFS only delivers the volume of fuel required by an engine, regardless of the varying degree of the volume of fuel required; however, the fuel pump operates at 100% capacity irrespective of engine demand, with excess fuel being discharged through a fuel pump module via the pressure regulator. Because the fuel pump operates at 100% regardless of engine demand, more electrical energy is consumed than would be if the pump speed could be varied in accordance with such engine demand. Additionally, with the fuel pump operating at 100% of its speed capacity at all times, pump wear may be greater than if the pump operates at a fraction of its 100% speed capacity. Finally, noise, vibration and harshness are higher, especially at engine idle, than they otherwise would be if the fuel pump speed could be controlled. In a MRFS no interaction with an electronic control module or vehicle body control module occurs.

Electronic returnless fuel systems ("ERFS") typically employ a pressure sensor in the engine fuel rail that communicates with a vehicle electronic control unit ("ECU"). The ECU may then communicate with a fuel pump controller which may use pulse width modulation ("PWM"), as an example, to control the voltage level across the fuel pump. By controlling the voltage level across the fuel pump, the pumping speed of the fuel pump, and accordingly its output volume, may be controlled. While such current MRFS and ERFS have generally proven to be satisfactory for their applications, each is associated with its share of limitations.

One limitation of current MRFS is that their fuel pumps operate at only one speed, that is, 100% of capacity, regardless of engine speed or engine fuel requirements. Operating in this manner may contribute to premature failure and necessary replacement of fuel pumps. Furthermore, noise, vibration and harshness, due to a fuel pump operating at 100% capacity at all times, is greater than a fuel pump that varies its speed. Additionally, at 100% capacity, the fuel pump draws a higher current and therefore diminishes fuel economy by placing a higher draw on the battery, and thus the alternator and consequently, on fuel consumption of the engine.

A limitation of current ERFS is that controlling the fuel pump is accomplished by using the vehicle ECU, and further communication with a fuel pump control unit. Such communication with a vehicle ECU requires extensive software programming and cross-coordination of engineering groups between fuel system suppliers and the supplier of the vehicle ECU. Furthermore, components such as exposed pressure sensors projecting from the fuel line at the engine are required and limit access to the engine by technicians or create an obstacle for adjacent parts.

What is needed then is a device that does not suffer from the above limitations. This, in turn, will provide a device that works similar to an MRFS, permits speed control of the fuel pump in accordance with engine fuel requirements, requires no cross-coordination with vehicle body ECU suppliers, does not require communication with a vehicle ECU, reduces consumption of electrical energy, and reduces noise, vibration and harshness.

SUMMARY

An adaptive fuel delivery module for a mechanical returnless fuel system utilizes a pressure sensor, which is part of the fuel pump module, within a casing that traditionally houses a pressure regulator, a jet pump supply orifice and a pressure relief valve. The pressure sensor communicates with a fuel pump voltage control module that communicates with the fuel pump to vary the speed of the fuel pump to maintain an average back pressure at the pressure sensor within the casing. Varying the speed of the fuel pump first involves inputting a sensed pressure to a continuously running trigger circuit logic routine that compares an absolute value of the difference between the sensed pressure and a mean pressure to a predetermined back pressure. If the absolute value is greater than the predetermined back pressure, a control circuit logic routine is enabled.

The control circuit compares the sensed pressure value to a high pressure threshold and a low pressure threshold and adjusts the speed of the fuel pump when the sensed pressure is beyond such thresholds. By adjusting the speed of the fuel pump, the back pressure of the fuel pump as sensed by the pressure sensor is maintained as close as possible to the average pressure. The trigger circuit routine is continuously operated while the control circuit is operated when invoked by the trigger circuit.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
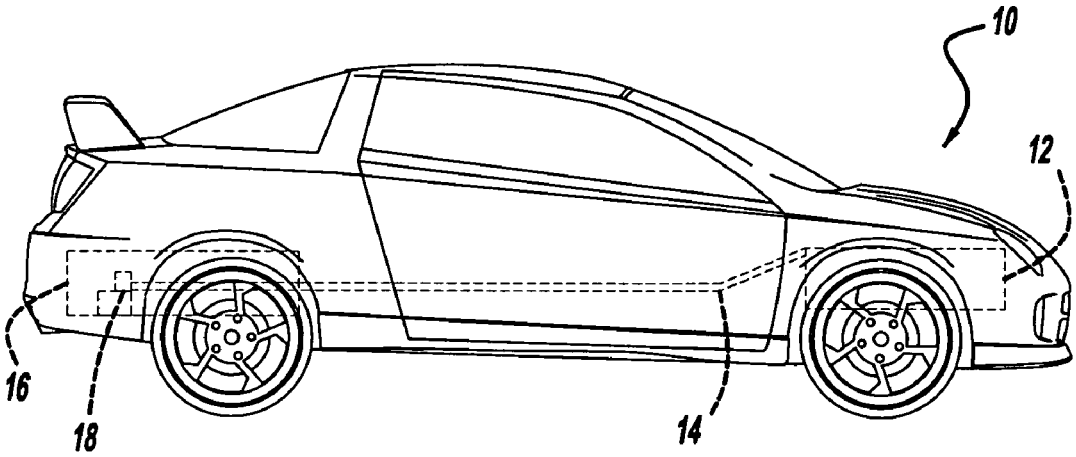
FIG. 1 is a side view of a vehicle depicting the general location of an engine and fuel system.

The following description is merely exemplary in nature and is not intended to limit the present disclosure, application, or uses. It should be understood that throughout the drawings, corresponding reference numerals indicate like or corresponding parts and features.

Figure 2:
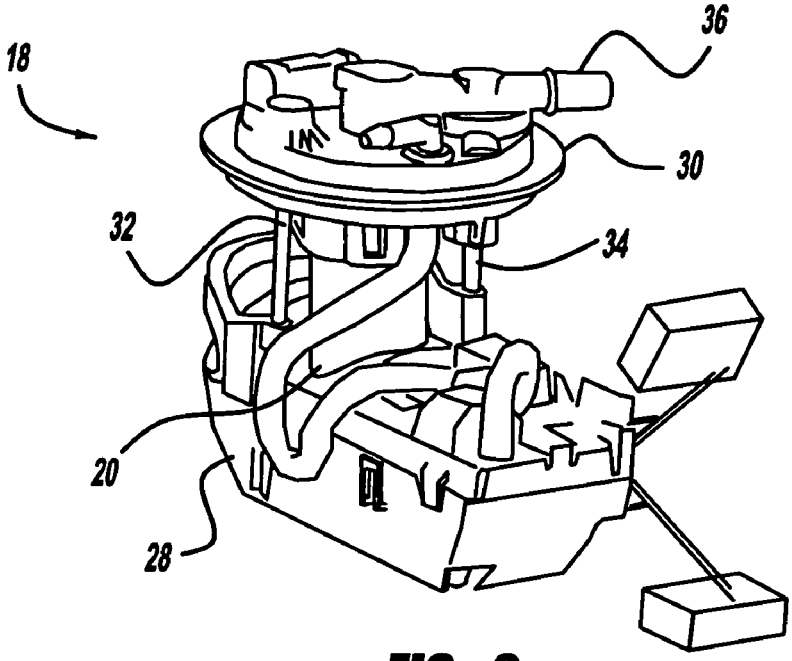
FIG. 2 is a perspective view of a fuel pump module.
Figure 3:
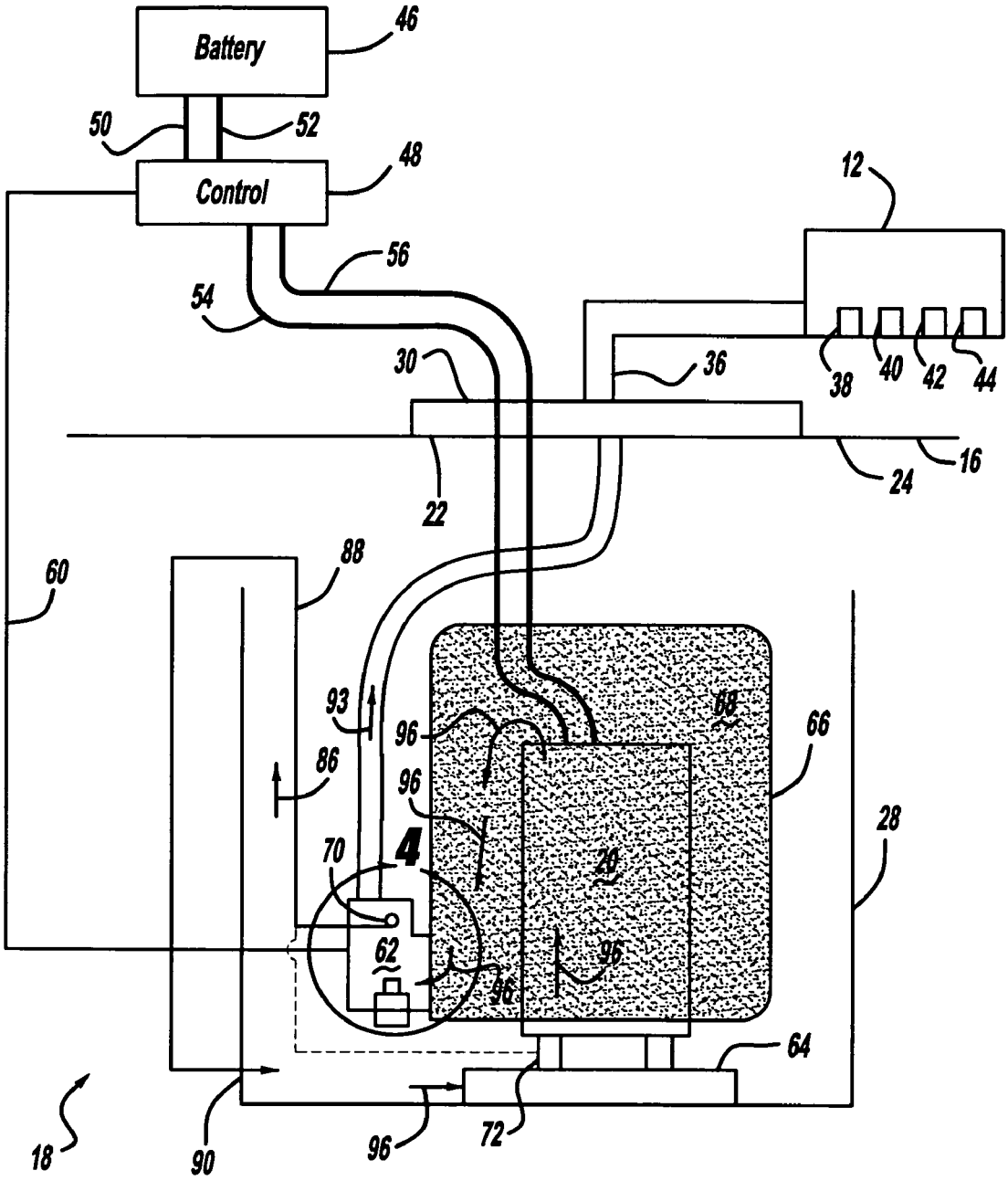
FIG. 3 is a side view of a fuel pump module depicting the location of a pressure regulator and jet pump.

With reference to FIGS. 1-9, description of an adaptive fuel delivery module for a mechanical returnless fuel system ("AMRFS"), in which a fuel pump 20 "adapts" to demand by the engine 12, will be described. FIG. 1 depicts a vehicle such as an automobile 10 having an engine 12, a fuel supply line 14, a fuel tank 16, and a fuel pump module 18. The fuel pump module 18 fits within the fuel tank 16, normally as a suspended component, and is normally submerged in or surrounded by varying amounts of liquid fuel within the fuel tank 16 when the fuel tank 16 possesses liquid fuel. A fuel pump 20 (FIG. 2) within the fuel pump module 18 pumps fuel to the engine 12 through the fuel supply line 14. FIG. 2 depicts one embodiment of a fuel pump module 18 that may be lowered through and installed about an aperture 22 (FIG. 3) in a top wall 24 of the fuel tank 16. Alternatively, such a fuel pump module may be installed or located on a side wall of a fuel tank; however, for exemplary purposes, the module 18 as depicted in FIGS. 2 and 3 will be used. While the fuel pump module 18 of FIG. 2 depicts a generally horizontally elongated reservoir 28, the reservoir 28 may be designed to be more vertically cylindrical, or other shape, any of which is suitable for the teachings of the present invention.

Continuing with FIGS. 2-3, a more detailed explanation of the fuel pump module 18, with which the invention operates, will be provided before depicting details of the invention. The fuel pump module 18 employs a fuel pump module flange 30 that mounts to the top wall 24 of the fuel tank 16. The flange 30 forms a seal, such as with an o-ring, with the top wall 24 and is secured to the fuel tank 16. First and second reservoir rods 32, 34 secure the fuel pump module reservoir 28 to the bottom interior wall of the fuel tank 16, with or without a biasing element such as a spring, as is known in the art. From the top of the flange 30, an engine fuel supply line 36 protrudes to deliver liquid fuel to the engine 12, and more specifically, to a series of engine fuel injectors 38-44. FIG. 3 also depicts a vehicle battery 46, a fuel pump voltage control module 48, electrical power lines 50, 52 between the battery 46 and the voltage control module 48, and electrical power lines 54, 56 between the voltage control module 48 and the fuel pump 20. The electrical power lines 54, 56 are used to vary the voltage across the fuel pump 20, whose main source of electrical power may be supplied by electrical power lines 54, 56, which may be connected to the vehicle wiring harness. A control line 60 permits control between the voltage control module 48 and a pressure sensor 92, which will be explained later. A sock type of fuel filter 64 may be attached to the bottom inlet of the fuel pump 20 while a filter case 66 houses a lifetime fuel filter 68 that may surround the fuel pump 20.

Figure 4:
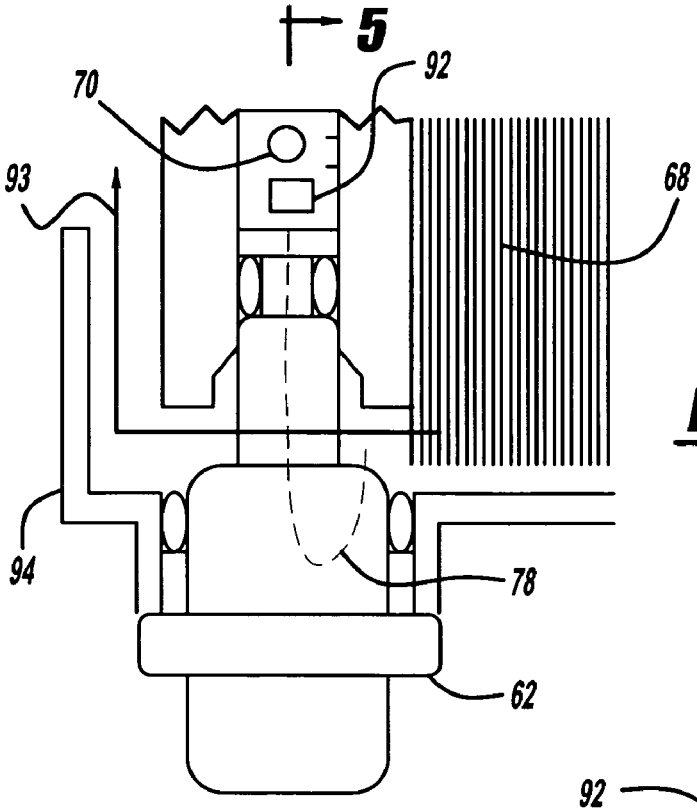
FIG. 4 is a side view of a casing depicting a pressure regulator and other internal operative workings.

FIG. 4 depicts a side view of a casing 94 attached to the fuel pump module 18. The casing 94 may house a pressure regulator 62, a pressure relief valve 74, and a jet pump feed orifice 70, as depicted. The jet pump feed orifice 70 is not limited to the location of orifice 70, but may also be located near the bottom of the fuel pump 20 as depicted at location 72. In yet additional applications, there may be a combination of orifices, such as in all wheel drive applications.

Figure 5:
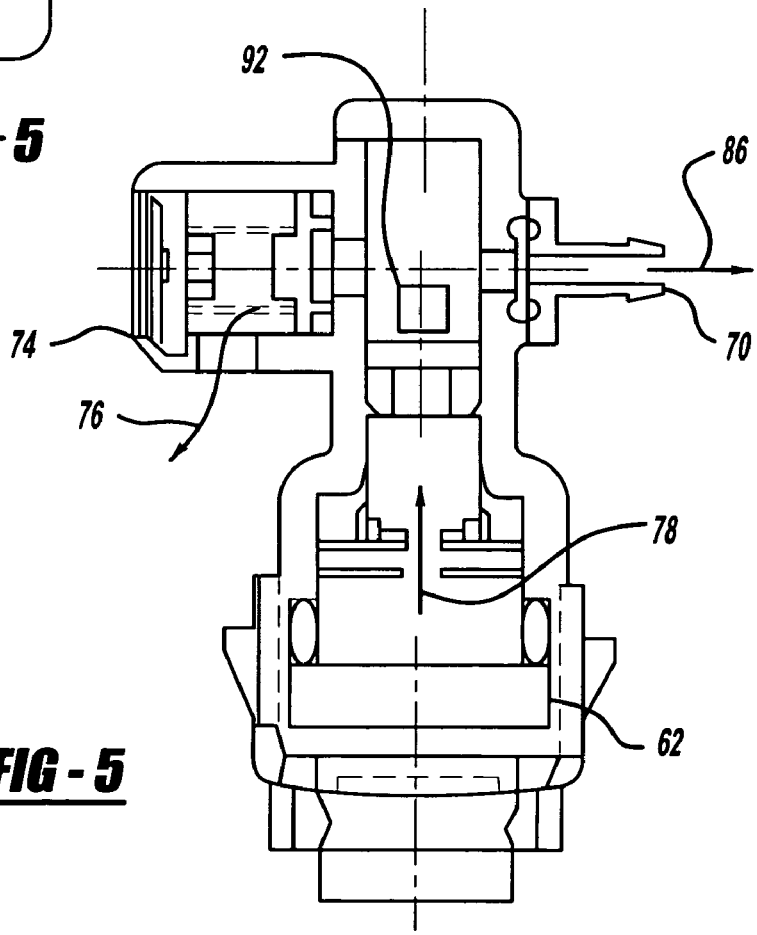
FIG. 5 is a cross-sectional side view of the casing of FIG. 4 depicting a jet pump orifice, a relief valve and the pressure regulator.

With continued reference to FIGS. 3-5, fuel within the fuel tank 16 and reservoir 28 is drawn into the fuel pump 20 through the fuel filter 64, also known as a sock filter 64. In accordance with arrows 96, the fuel passes through the fuel pump 20 and into the filter 68 surrounding the fuel pump 20 and then into the casing 94 that houses the pressure regulator 62, relief valve 74, jet pump supply orifice 70, and pressure sensor 92. Upon entering the casing 94, the fuel flow divides with some fuel flowing in accordance with arrow 93 up to flange 30 and into the fuel supply line 36 to be delivered to the engine 12. Since there is no return fuel line from the engine 12, all of the fuel that flows into the fuel supply line 36 and fuel supply line 14 (FIG. 1), is combusted at the engine 12. At the same time, some fuel flows in accordance with flow arrow 78 to jet pump feed orifice 70 and then from the orifice 70 in accordance with flow arrow 86 and into tube 88 where it is guided back into the reservoir 28 at an orifice, such as a jet pump 90. The jet pump 90 creates a venturi effect and therefore draws fuel from the fuel tank 16 into the reservoir 28. The orifice 90 also causes a back pressure in the casing 94 upstream of the orifice 90. In the event that the pressure in the casing 94 exceeds a preset level, a relief valve 74 opens and permits fuel to flow into the reservoir 28. Also housed within the casing 94 is a pressure sensor 92 whose function as part of the teachings of the present invention will be explained shortly.

Figure 6:
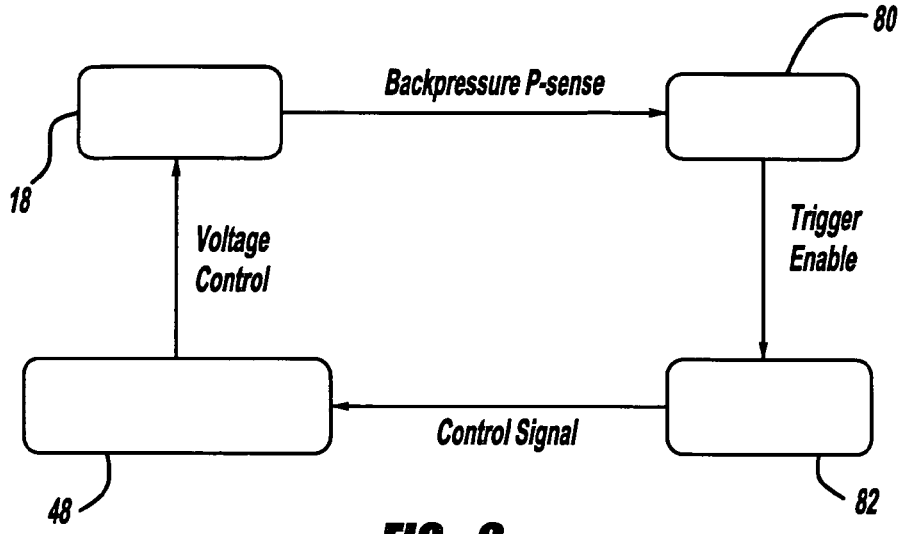
FIG. 6 is a flowchart depicting a general control logic flow for controlling the fuel pump according to the present invention.

With continued reference to FIGS. 3-5 and additional reference to FIGS. 6-8, detailed operation of the present invention will now be explained. FIG. 6 depicts a flowchart of the general flow of control logic for controlling the fuel pump according to the present invention. Generally, the pressure sensor 92 of the fuel delivery module 18 ("FDM") inputs a backpressure value to a trigger circuit 80. When certain criterion within the trigger circuit 80 is met, control is passed onto a control circuit 82. In accordance with the evaluation of the control circuit 82, a fuel pump voltage control module 48 controls the voltage across the fuel pump 20 using techniques involving resistors or pulse width modulation ("PWM"). Thus, controlling the speed of the fuel pump 20 is accomplished by altering the voltage across the fuel pump 20.

Continuing, when the back pressure within the casing 94 is greater than a predetermined pressure, the relief valve 74 discharges fuel and pressure in accordance with arrow 76, into the fuel tank 16, and more specifically, into the reservoir 28 to prevent the fuel pressure from exceeding a certain pre-determined pressure. The discharged fuel may once again be drawn into the fuel pump 20 at the sock filter 64 depicted at the bottom of the fuel pump 20. Additionally, the orifice 70 also discharges fuel not destined for combustion, as depicted with flow arrow 86. The flow in accordance with arrow 86 may travel through a jet pump tube 88 and be directed into the bottom of the reservoir 28 at the jet pump 90. Fuel that is not discharged into the reservoir 28 flows in accordance with flow arrow 93, which is high pressure fuel en route to the engine 12 in fuel line 14. FIG. 5 also depicts fuel flow, with fuel flow arrow 78, which is fuel that may either be directed out of the orifice 70 or the relief vale 74, if a vehicle is so equipped. To elaborate, orifice 70 may only be required if the fuel delivery module employs no jet pumps or a jet pump or pumps driven by "main-side" flow, such as flow not directed through the pressure regulator.

With continued reference to FIGS. 4-8, the pressure sensor 92 may be located within the casing 94 that also houses the pressure regulator 62, orifice 70 and relief valve 74. The pressure sensor 92 continuously senses the fuel pressure downstream of the pressure regulator 62 and more specifically, senses the pressure between the pressure regulator and the orifice 70 or jet pump 90. By monitoring the back pressure within the casing 94, the fuel demand by the engine 12 may be estimated. Generally, when the engine demand is minimal, such as at idle, the back pressure is maximum, and when the engine demand is greatest, such as during wide open throttle ("WOT"), the back pressure is at a minimum. By monitoring the back pressure in the casing 94 and varying the voltage across the fuel pump 20, the speed of the fuel pump 20 and thus the volume of fuel pumped may be varied in accordance with the volume required by the engine. By monitoring the back pressure with the pressure sensor 92, inputs may be provided to a logic switch circuit within the voltage control module 48 to thereby relay voltage changes to the fuel pump 20.

Figure 7:
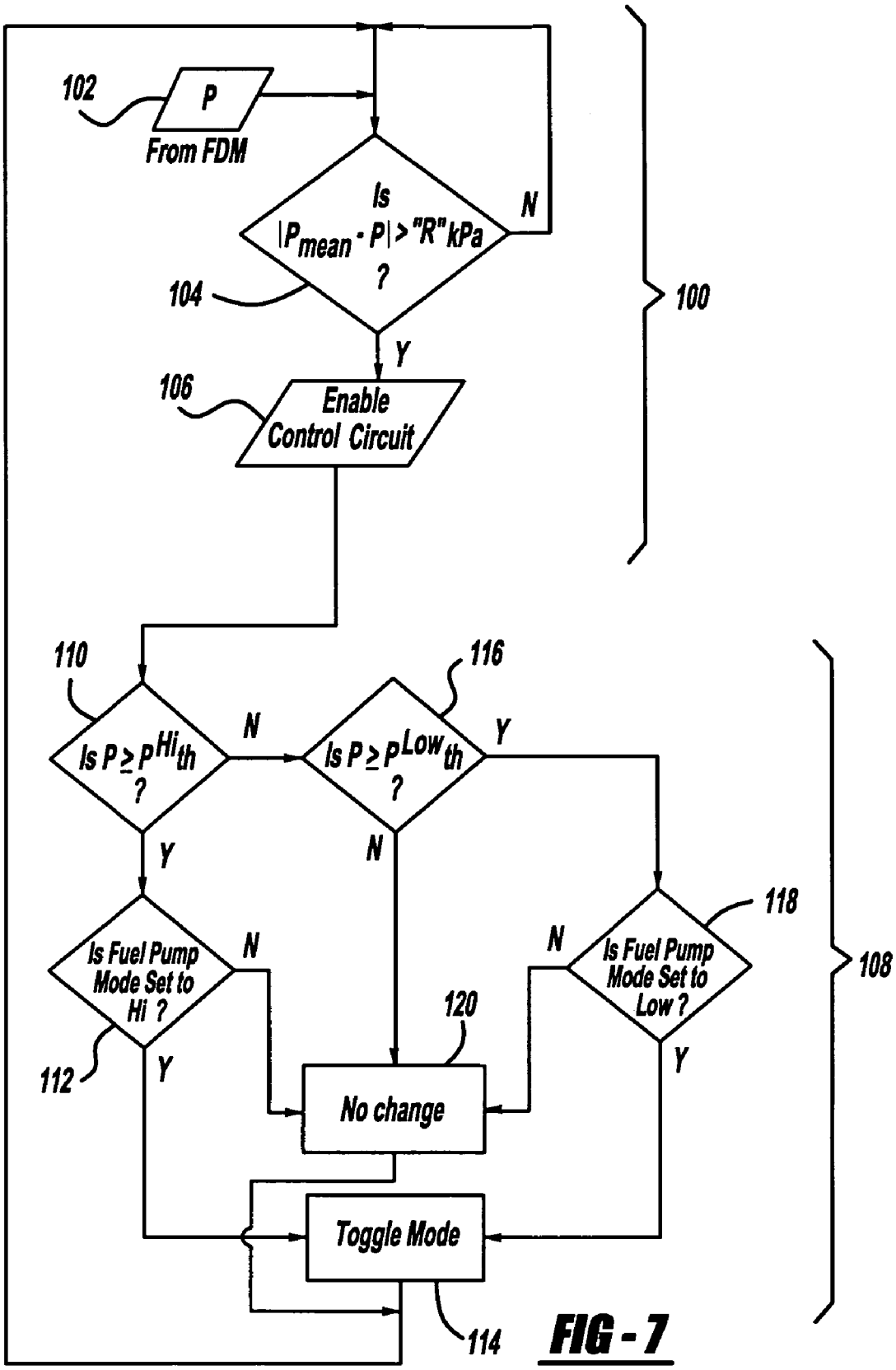
FIG. 7 is a flowchart depicting control logic for controlling the fuel pump according to the present invention.

A more detailed explanation of the present invention will now be provided with reference to FIGS. 3-8. The voltage control module 48 receives input from the fuel delivery module 18 in the form of a back pressure as sensed by the pressure sensor 92. The back pressure, in kilopascals (kPa) for example, is input into a trigger circuit 100 at pressure input block 102 as depicted in FIG. 7. The trigger circuit 100 is a continuous routine that monitors the pressure read at the pressure sensor 92 within the casing 94, between the orifice 70 and the pressure regulator 62.

Figure 8:
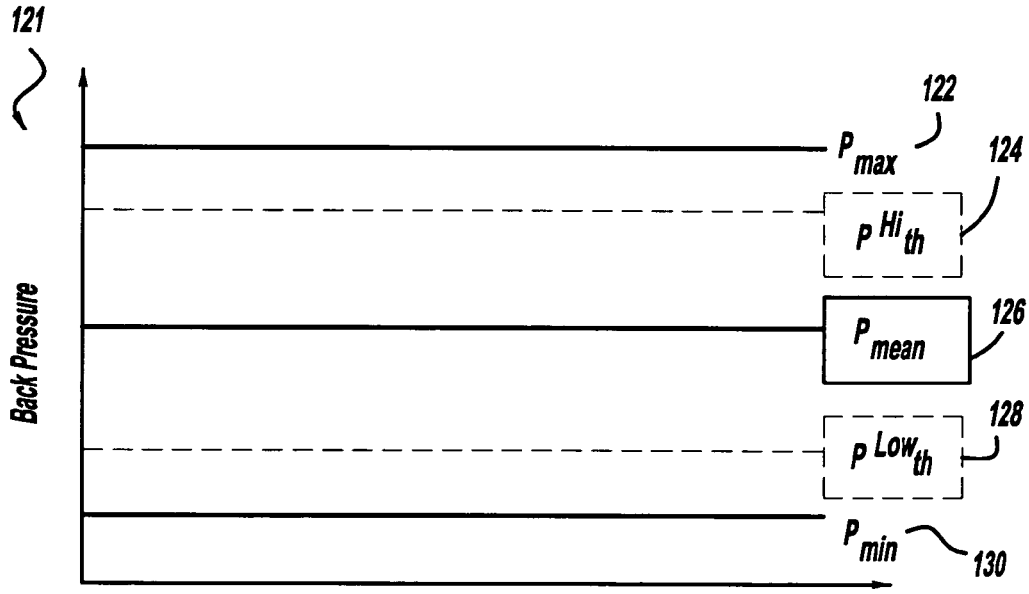
FIG. 8 is a chart depicting back pressure levels used in controlling the fuel pump of the fuel system according to the present invention.

Upon the back pressure "P" being read into the trigger circuit 100 at input block 102, it passes to decision block 104 where it is compared to the mean pressure "$P_{mean}$." $P_{mean}$ is the desired level of the back pressure to be read at the pressure sensor 92 and may be computed as $(P_{max}+P_{min})/2$ as depicted in FIG. 8. By controlling the back pressure, by varying the fuel pump speed, to always be maintained at or as close as possible to $P_{mean}$, the engine fuel consumption and fuel supply to the jet pump 90 are ensured to be as balanced as possible. If the absolute value of the difference between P and $P_{mean}$ is greater than a predetermined pressure amount, say 5 kPa as denoted by "R" in decision block 104, then the trigger circuit 100 passes control to the input block 106, which permits the control to leave the trigger circuit and enter the control circuit 108. However, if the pressure difference between P and $P_{mean}$ is not greater than the predetermined pressure amount of 5 kPa, then the trigger circuit returns control to the beginning of the trigger circuit 100 to begin iteration.

In the above explanation, 5 kPa represents the amount of tolerance that the back pressure is permitted to stray from $P_{mean}$, either higher or lower, before correction back to $P_{mean}$ is invoked. When the sensed pressure is greater than 5 kPa, the engine 12 is regarded as being in the process of either increasing or decreasing in speed to the extent that alteration of the fuel pump speed may be necessary. The control circuit 108 will confirm such perceived need.

Once control proceeds to the control circuit 108, the control logic of the trigger circuit 100 has determined that because the detected pressure is at least 5 kPa from the mean pressure ($P_{mean}$), the engine 12 may be demanding more or less fuel as detected by the pressure sensor 92. Generally, when the engine 12 demands an increasing or sustained increased quantity of fuel, such as during engine acceleration or maintained high vehicle speeds, the pressure sensor 92 will detect a decreasing or sustained decreased fuel back pressure, respectively. Likewise, when the engine 12 demands a decreasing or sustained decreased quantity of fuel, such as during engine deceleration or sustained slow speeds, the pressure sensor 92 will detect an increasing fuel back pressure or sustained increased fuel back pressure.

Upon entering the logic of the control circuit 108, the back pressure measured by the pressure sensor 92 is compared to a high pressure threshold ("$P^{Hi}_{th}$") in decision block 110. $P^{Hi}_{th}$ is a threshold limit that is selected to be a particular percentage less than the maximum operating pressure of the fuel system, or alternatively it may be limited to be the allowable back pressure on the pressure regulator 62 for durability purposes. For example, $P^{Hi}_{th}$ could be set to be 5% or 10% below the maximum operating fuel pressure. Continuing with the control circuit 108, if the answer to the inquiry at the decision block 110 is "Yes", then the logic flows to decision block 112, where the mode of the fuel pump 20 is queried. The decision block 112 asks if the mode of the fuel pump 20 is set to "high," which is the maximum fuel pumping mode of the fuel pump 20, or at least the fuel pumping mode capable of supplying the highest demand, or more than the highest demand, of the engine 12. If the result of this inquiry is "Yes," then the logic flows to block 114 where the voltage across the fuel pump is toggled or changed when a toggle mode is invoked. That is, the voltage across the fuel pump 20 is lowered to slow the speed of the fuel pump 20, which will in turn lower the fuel pressure to or closer to $P_{mean}$. Again, $P_{mean}$ is an average back pressure calculated such that $P_{mean}=(P_{max}+P_{min})/2$, which is in accordance with the depicted back pressures of FIG. 8.

Returning to decision block 110, if the result of the inquiry is "No," then the logic flows to decision block 116. At decision block 116, an inquiry is made as to whether the detected or measured fuel back pressure "P" measured at the pressure sensor 92 is less than $P^{Low}_{th}$. $P^{Low}_{th}$ is a threshold limit that is selected to be a particular percentage higher than the minimum operating pressure of the fuel system. For example, $P^{Low}_{th}$ could be set to be 5% or 10% greater than the minimum operating fuel pressure. The threshold limits, $P^{Low}_{th}$ and $P^{Hi}_{th}$, may be set such that the average operating pressure, $P_{mean}$, is the average of such values, but such is not required.

If the answer to the inquiry at decision block 116 is "Yes", then the logic flows to decision block 118 where the logic inquires whether the operating mode of the fuel pump 20 is set to its "Low" mode. If the fuel pump is set to its "Low" mode, and the pressure sensor 92 is sensing a fuel pressure below its $P^{Low}_{th}$ value, then this means that the engine 12 is demanding fuel at such a volume that the pressure has dropped or is dropping. To compensate for the drop in pressure and to supply a greater volume of fuel to the engine 12, the logic flow proceeds to block 114 where the voltage across the fuel pump 20 is changed or toggled in such a fashion to increase the speed of the fuel pump 20 such that the fuel pressure and volume increase and the back pressure moves towards and achieves the $P_{mean}$ back pressure level.

Although pressure-changing logic paths have been addressed above, several paths cause no voltage change across the fuel pump 20, and thus, no change in fuel pump 20 speed, output volume, or back pressure. The first situation is if a "No" response results at decision block 112, the second occurs when a "No" response results at decision block 116, and the third is when a "No" response results at decision block 118. In all three situations, the logic flow proceeds to block 120 such that no change results in the voltage across the fuel pump 20. With no change in the voltage across the fuel pump at block 120, control returns to the trigger circuit 100 where the back pressure "P" is again input into the routine at input block 102. Similarly, even if a change in fuel pump voltage is carried out at block 114, as a result of inquiries made at decision blocks 110-112 and 116-118, control then exits the control circuit 108 and returns to the trigger circuit 100. Changing the voltage across the fuel pump 20, and hence the fuel back pressure within the fuel system, may be accomplished with the use of a solid state device, for example, to ensure quick switching without any significant pressure fluctuations or ripples in the high pressure fuel line 14, 36.

While the flowchart of FIG. 7 depicts fuel pump modes such as high and low modes, additional fuel pump speed settings may be utilized to more specifically meet the fuel pressure requirements. With such an arrangement, a look up table may be utilized to set the fuel pump speed. For instance, at block 114, instead of changing the fuel pump speed from high to low, for example, a look up table could be reference to select from a wide range of speeds to meet the pressure requirements of the routine to direct the pressure back to $P_{mean}$. As an alternative to specific speeds, a continuously variable fuel pump may be utilized to meet the fuel pressure requirements of the routine.

FIG. 8 is a chart 121 depicting back pressure levels used in controlling the fuel system in accordance with the flowchart of FIG. 7, as explained above. More specifically, the chart 121 depicts pressures: $P_{max}$ 122, $P^{Hi}_{th}$ 124, $P_{mean}$ 126, $P^{Low}_{th}$ 128 and $P_{min}$ 130. $P_{max}$ 122 may pertain to a fuel flow situation such as an engine at idle or the maximum allowable pressure based on the durability of the pressure regulator 62 and as an example, the overall design of the fuel pump module 18. $P_{min}$ might pertain to a fuel pressure situation such as the minimum pressure necessary to ensure that the jet pump 90 is able to function properly. $P^{Hi}_{th}$ 124 and $P^{Low}_{th}$ 128, as discussed previously, are threshold levels that are back pressure set points, 5%-10%, as examples, from the $P_{max}$ and $P_{min}$ pressures. When the back pressures move beyond the thresholds, correction measures regarding the back pressure P are invoked by the routine of FIG. 7.

Continuing with an explanation of the pressures involved, $p^{Hi}_{th}$ may be 90% of $P_{max}$, while $P^{Lo}_{th}$ may be 110% or 1.1 times $P_{min}$. The relief valve 74 may open if the fuel pressure obtains the $P_{max}$ level, while the relief valve 74 may be set to close at pressures below the $P_{max}$ level. Although the relief valve 74 is depicted in FIG. 5, because of the voltage control of the fuel pump 20 in accordance with the teachings of the present invention, the relief valve 74 may be eliminated. Stated another way, because the speed of the fuel pump 20 and thus the fuel back pressure will be varied in accordance with the teachings of the present invention, the relief valve 74 may not be needed to compensate for high pressures. Nonetheless, the relief valve 74 may be maintained to compensate for high pressures caused when the fuel pump is not operating, such as during hot days immediately after turning off the engine, such as in a dead soak situation or on a gasoline-electric hybrid vehicle, when the engine may be repeatedly stopped on a hot roadbed on hot days. During periods when the engine is stopped, adjustment of the voltage across the fuel pump 20 does not occur.

There are multiple advantages of the teachings of the present invention. First, the fuel pump 20 will undergo continuous changes in its speed as a result of the control provided by the voltage control module 48. Although various types of a control module 48 are possible, a resistor based switch or a PWM (pulse width modulation) utilizing duty cycle control is possible. Another advantage is that since the fuel pump 20 is not operating at 100% of its pumping capacity when the engine is running, electrical energy is conserved. Since electrical energy is conserved, the engine 12, which provides rotational energy to an alternator (not shown) which supplies electrical energy to the battery 46, the alternator does not consume as much rotational energy from the engine 12, thus conserving gasoline in the combustion process and increasing the fuel mileage of the vehicle. Additionally, because the fuel pump 20 is operating at reduced and varying speeds compared to traditional MRFS versions of the pump that run at 100% of capacity as long at the engine is operating, the life of the fuel pump may be prolonged, and noise, vibration, and harshness may be reduced. Another advantage is that the adaptive MRFS of the present teachings is capable of replacing a traditional MRFS in vehicles currently in use, if repair or replacement of the traditional MRFS becomes necessary. Finally, the AMRFS of the present teachings permits some of the advantages of an ERFS without any interaction with a vehicle's electronic control unit. That is, only the controller of the AMRFS is utilized.

What is claimed is:

1. A method of controlling a fuel pump, comprising:

sensing a fuel module back pressure with a pressure sensor within a pressure regulator case;

subtracting the back pressure from a mean pressure to obtain a pressure difference;

comparing the pressure difference to a predetermined pressure; and adjusting a speed of the fuel pump in accordance with the comparison.

2. The method according to claim 1, wherein adjusting the speed of the fuel pump further comprises:

comparing the back pressure to a first pressure threshold value; and changing a speed of the fuel pump based upon the comparison of the back pressure to the first pressure threshold value.

3. The method according to claim 1, wherein adjusting the speed of the fuel pump further comprises:

comparing the back pressure to a first pressure threshold value;

querying whether the fuel pump is in a high speed mode; and changing a speed of the fuel pump based upon the comparison of the back pressure to the first pressure threshold value.

4. The method according to claim 1, wherein adjusting the speed of the fuel pump further comprises:

comparing the back pressure to a first pressure threshold value;

comparing the back pressure to a second pressure threshold value; and changing a speed of the fuel pump based upon the comparison of the back pressure to the first pressure threshold value.

5. The method according to claim 1, wherein adjusting the speed of the fuel pump further comprises:

comparing the back pressure to a first pressure threshold value;

comparing the back pressure to a second pressure threshold value;

querying whether the fuel pump is in a low speed mode; and changing a speed of the fuel pump based upon the comparison of the back pressure to the second pressure threshold value.

6. The method according to claim 1, wherein adjusting a speed of the fuel pump further comprises varying the speed from an existing speed mode.

7. The method according to claim 1, wherein adjusting a speed of the fuel pump further comprises adjusting a speed in accordance with a look up table.

8. A method of controlling a fuel pump, comprising:

sensing a fuel module back pressure with a pressure sensor within a pressure regulator case, the pressure sensor located between a pressure regulator and a jet pump discharge orifice;

calculating an absolute value of the difference between the sensed back pressure and a mean pressure to obtain a pressure difference;

comparing the pressure difference to a predetermined pressure; and adjusting a speed of the fuel pump in accordance with the comparison.

9. The method according to claim 8, wherein adjusting the speed of the fuel pump further comprises:

comparing the back pressure to a first pressure threshold value; and changing a speed of the fuel pump based upon the comparison of the back pressure to the first pressure threshold value.

10. The method according to claim 8, wherein adjusting the speed of the fuel pump further comprises:

comparing the back pressure to a high pressure threshold value;

querying whether the fuel pump is in a high speed mode; and changing a speed of the fuel pump based upon the comparison of the back pressure to the high pressure threshold value.

11. The method according to claim 8, wherein adjusting the speed of the fuel pump further comprises:

comparing the back pressure to a high pressure threshold value;

comparing the back pressure to a low pressure threshold value; and changing a speed of the fuel pump based upon the comparison of the back pressure to the high pressure threshold value.

12. The method according to claim 8, wherein adjusting the speed of the fuel pump further comprises:

comparing the back pressure to a high pressure threshold value;

comparing the back pressure to a low pressure threshold value;

querying whether the fuel pump is in a low speed mode; and changing a speed of the fuel pump based upon the comparison of the back pressure to the second pressure threshold value.

13. The method according to claim 8, wherein sensing a fuel system back pressure with a pressure sensor further comprises sensing the fuel system back pressure with a pressure sensor adjacent a jet pump supply orifice.

14. The method according to claim 8, wherein sensing a fuel system back pressure with a pressure sensor further comprises sensing the fuel system back pressure with a pressure sensor within a pressure regulator case.

15. A method of controlling a fuel pump, comprising:

calculating a mean pressure based upon a maximum fuel pump operating pressure and a minimum fuel pump operating pressure;

sensing a fuel system back pressure with a pressure sensor located in a pressure regulator casing, wherein the pressure sensor in the pressure regulator casing is located between a pressure regulator and a jet pump orifice and downstream of the pressure regulator;

calculating an absolute value of the difference between the sensed back pressure and the mean pressure to obtain a pressure difference;

comparing the absolute value to a predetermined pressure; and changing a speed of the fuel pump in accordance with the comparison.

* * * * *